US008739975B2

(12) United States Patent
Li

(10) Patent No.: US 8,739,975 B2
(45) Date of Patent: Jun. 3, 2014

(54) INTEGRATED DRYING AND DRY SEPARATION APPARATUS FOR UPGRADING RAW COAL AND METHOD THEREOF

(76) Inventor: Gongmin Li, Tamhan (CN)

( * ) Notice: Subject to any disclaimer, the term of this patent is extended or adjusted under 35 U.S.C. 154(b) by 0 days.

(21) Appl. No.: 13/510,642

(22) PCT Filed: Nov. 19, 2010

(86) PCT No.: PCT/CN2010/001858

§ 371 (c)(1),
(2), (4) Date: May 18, 2012

(87) PCT Pub. No.: WO2011/060620

PCT Pub. Date: May 26, 2011

(65) Prior Publication Data

US 2012/0228197 A1 Sep. 13, 2012

(30) Foreign Application Priority Data

Nov. 19, 2009 (CN) ..... 2009 1 0223760

(51) Int. Cl.
*B03B 9/06* (2006.01)

(52) U.S. Cl.
USPC ..... 209/11; 209/3; 209/10; 241/24.24; 241/24.31

(58) Field of Classification Search
USPC ..... 209/3, 11, 8, 10, 238, 241; 44/620, 626; 241/24.24
See application file for complete search history.

(56) References Cited

U.S. PATENT DOCUMENTS

| | | | | |
|---|---|---|---|---|
| 4,252,638 | A * | 2/1981 | Bender et al. | 241/16 |
| 7,367,456 | B2 * | 5/2008 | Oder et al. | 209/39 |
| 7,708,145 | B2 * | 5/2010 | Li et al. | 209/471 |
| 8,062,410 | B2 * | 11/2011 | Bullinger et al. | 95/288 |
| 2007/0023327 | A1 * | 2/2007 | Li et al. | 209/44 |

FOREIGN PATENT DOCUMENTS

| | | |
|---|---|---|
| CN | 101440323 | 5/2009 |
| CN | 101705131 | 5/2010 |
| CN | 101705132 | 5/2010 |
| CN | 201558751 | 8/2010 |
| CN | 201560180 | 8/2010 |
| CN | 201593043 | 9/2010 |

* cited by examiner

*Primary Examiner* — Luis A Gonzalez
(74) *Attorney, Agent, or Firm* — Greer, Burns & Crain, Ltd.

(57) ABSTRACT

An integrated drying and dry-separating apparatus for upgrading raw coal includes a coal supply system, a hot air system, a drying system, a dedusting and exhausting system, and a dry-separating system. The coal supply system conveys raw coal to the hot air system and the drying system by a raw coal conveyer respectively. The hot air system is a heat source of the drying system. The drying system is used for drying and dewatering the raw coal. The dedusting and exhausting system is consisted of a deduster and an exhaust fan, and establishes a connection between the drying system and the dry-separating system. The dry-separating system includes a dry separator, a circulating fan, and a cyclone deduster, which is used for separating dried raw coal into fancy coal, middling coal and coal gangue. A method for dry-separating and drying raw coal using the apparatus is also provided.

8 Claims, 2 Drawing Sheets

INTEGRATED DRYING AND DRY SEPARATION APPARATUS FOR UPGRADING RAW COAL AND METHOD THEREOF

TECHNICAL FIELD

The present invention relates to material separation field, and in particular to an integrated drying and dry separation apparatus for upgrading raw coal and method thereof, which are also suitable for separation and upgrading of other material.

BACKGROUND

Water content, ash content and sulfur content are important factors for coal that influence the coal quality. In order to improving the coal quality, coal must be dehydrated and separated. With the development of technique of coal upgrading, the drying process and dry separation process for coal are widely used therein, and have obtained remarkable success.

For example, a drying equipment for coal slime has been disclosed in China patent CN 2494964Y, which is composed of a fluidized bed drying portion and a heat source supplying portion; wherein the fluidized drying portion is composed of a coal conveyor, a crusher, a pre-dryer, a screw feeder, a fluidized bed boiling dryer, a two-stage whirlwind separator, and a belt conveyor which are connected in sequence; and the heat source supplying portion is composed of a flue gas furnace, a mixer and an auxiliary assembly. In addition, a separation bed vibration device of air jigging-based dry separator has been disclosed in China patent CN 2889494Y, which comprises a vibration motor and elastic components, wherein the vibration motor is connected fixedly with the separation bed, and a rotation axis of the vibration motor is perpendicular to the screen deck of the screen plate of the separation bed; according to the working characteristic that the air jigging-based dry separation method uses the air as a media to form air jigging layers in the material to be separated, it adopts such a design for the vibration device that vibration motors with the same specification are mounted symmetrically and an output axis of the vibration motor is perpendicular to the working surface of the separation bed, which allows the vibration direction of the separation bed to be consistent with the output direction of the material, and allows the material to enter the material discharging device with shorter route during the processes of lifting up, jigging and layering of the material on the separation bed depending on the wind force, without bearing the movement for throwing the material upward on the vibration motor.

A dry separation process has been disclosed in "optimal research on coal drying system", "Journal of china coal society", No. 4, 2004, wherein according to the control requirement of the water content of the raw coal to be separated by the air dense medium fluidized bed dry separation method, taking gradation composition characteristic and water content distribution characteristic of coal particles with their sizes in a range from 50 mm to 6 mm into consideration, the thin layered coal moves quickly to the discharge end from feeding end on the grid plate with the effect of the vibration machine, and the hot air flow passing through the gird plate and coal layers from bottom to top exchanges considerable thermal mass with the coal particles so as to allow the free water on the coal particle surface to be evaporated quickly.

In particular, as an effective and useful technique for recrement excluding and sulfur reducing of the coal, the integrated dry separation method has been fast spread and widely used due to its unique characteristics such as saving the water source, avoiding the secondary pollution of slime water, simple process, low investment and low production cost, which are suitable for the demands of coal enterprises in China, and provides a economic and useful coal separation method for coal fabrication processing.

However, one of the major factors that influences whether the dry separation method can be used is the water content of raw coal, and the dry separation method could not be directly used due to the low separation effect thereof in the case that the outside water content of coal exceeds 9%. Further, China is rich in lignite resource, but serious in pelitization issue when coal meets water, therefore the dry separation method have to be used; however the major factors influencing the spread of dry separation method lie in the low metamorphism grade and high water content. In another aspect, the drying device needs plentiful heat source and sufficient drying time during drying the coal with high water content, and the processing ability is in inverse proportion to the dehydration strength; at present, the dehydration strength of the drying device is severely restricted to a range of 6-12% because the goal of drying device is to increase the production quantity and the calorific value only depending on drying means is limited. As a comparison, the investment and production cost of the drying device with the same scale is 3-4 times as great as that of the dry separation.

In consideration of equipment and economy, using the drying device and the dry separation device respectively leads to the dry separation method difficult to be spread due to the restriction of the raw coal quality, and difficult to be accepted by the investors due to the restriction of the large investment. There is no effective means yet to solve the problems mentioned above due to the present technique level at home or abroad.

In addition, it is well known that China is a big country of coal production and consumption, and coal occupies 75% of the primary energy constitution. A large quantity of coal is converted into electric power for supporting the national economy construction. For raw coal produced in 1997, 523 million tons among 1325 million tons are used to generate electricity, that is, coal-fired power plants consume 39.5% of national coal production quantity as the biggest coal consumers. The state that electricity generation is depending on the coal as major energy is also present in many developed countries. For example, the U.S.A. as a major country for generating electricity and producing coal, 86%-89% of the total quantity of its national coal consumption is used for power plant. Thus the foundation investment, economy operation and environment influence of the coal-fired power plant are in associated with the coal quality to a great extent. The fees for coal occupy 80% of the cost of thermal power generation. Therefore, improving the coal quality has vital influence on coal-fired power plants.

Therefore, it is desirable to provide an equipment and a method for improving coal quality which can solve the problems mentioned above and meet the requirements of country and industry for the sustainable development, environment protection and energy saving.

SUMMARY

Based on long-term technical development and research, the present invention provides an integrated drying and dry separation apparatus for upgrading raw coal, and method thereof which can resolve the defect attributed to respectively using drying and dry separation, and realize both the sharing between equipments with the same function and the recycling of by-product (such as coal gangue) energy produced during the coal separation, by means of a joint operation of drying and dry separation.

According to the first aspect of the present invention, it provides an integrated drying and dry separation apparatus for upgrading raw coal, comprising a coal supply system, a hot air system, a drying system, a deducting and exhausting system, and a dry separation system, wherein the coal feeding system can be divided into two portions, that is, a coal supply for dry raw coal and a coal supply for hot air furnace; the coal supply system supplies raw coal to the hot air system and the drying system respectively by using a raw coal conveyor; the hot air system is a heat source portion of the drying system, it comprises a hot air furnace, a settling chamber and a first main fan; the hot air system supplies hot air with certain temperature pressurized by the first main fan to the drying system, wherein said hot air with certain temperature is formed by removing sparks from flue gas produced in the hot air furnace when passing through the settling chamber and then mixing the processed flue gas with cold air; an air outlet of a first draught fan is connected to the lower portion of a dryer in the drying system; the drying system configured to dry and dehydrate the raw coal, and to reduce the water content of the raw coal; wherein the dried coal products are conveyed to the dry separation system by a conveyor for dried product; the dedusting and exhausting system configured to recycle fine particles of coal dust, comprising a dust remover and an exhaust blower, and connected between the drying system and the dry separation system; said exhaust blower consists of a draught fan and an exhaust pipe; the dry separation system comprises a dry separator, a circulating fan and a cyclone dust remover, and configured to separate the dried raw coal into fancy coal, middling coal and coal gangue.

Preferably, the temperature of said hot air formed by removing sparks from flue gas produced in the hot air furnace when passing through the settling chamber and then mixing the processed flue gas with cold air is about 50° C.-280° C.

Preferably, the temperature of said hot air formed by mixing with the cold air is about 250° C.

Preferably, the raw coal conveyor is a belt conveyor for raw coal, and the dried product conveyor is a belt conveyor for dried products.

Preferably, the core equipment of the drying system is mixed-flowing vibrating dryer.

Preferably, the dry separator of the dry separation system is a composite dry separator.

Preferably, the hot air furnace is a chain type hot air furnace or a boiling type hot air furnace.

According to the second aspect of the present invention, it provides an integrated drying and dry separation method for upgrading raw coal, comprising the following steps, 1) supplying coal for drying and coal for a hot air furnace by using a coal supply system; the hot air furnace is a chain type hot air furnace or a boiling type hot air furnace; the raw coal is directly used as fuel of the chain type hot air furnace when the lower heating value of the raw coal is bigger than 16000 KJ/kg, namely bigger than 3840 kilocalorie/kg; the boiling type hot air furnace is adopted as the hot air furnace of the coal supply system when the lower heating value of the raw coal is smaller than 16000 KJ/kg;

2) supplying hot air with temperature between 150° C.-280° C. pressurized by a first main fan to the lower portion of a dryer in a drying system by using a hot air system, wherein the hot air is formed by removing sparks from flue gas produced in the hot air furnace when passing through a settling chamber and then mixing the processed flue gas with cold air;

3) using the drying system to dry the raw coal: the drying system uses a mixed-flowing vibrating dryer, the coal flow passes through a multi-layered vibration bed from top to bottom and flows to a coal outlet, the hot air passes through the multi-layered vibration bed and is discharged via a top exhaust outlet, the macro-flow between the coal flow and the hot air is a counter flow, that is, both a vertical cross flow and a horizontal counter flow between the coal and the hot air are present within the dryer;

4) using a dedusting and exhausting system to remove the dust: the dedusting and exhausting system is composed of a dust remover and an exhaust blower, the dust remover separates coal powder from exhaust gas, and the separated coal powder is incorporated into coal product, the processed, cleaned exhaust gas is evacuated via the exhaust blower;

5) using a dry separation system to separate dried raw coal into fancy coal, middling coal and coal gangue, the fancy coal can be sold as coal product, the middling coal can be either incorporated into the fancy coal to be sold as coal product or returned to coal inlet to be separated again, part of the coal gangue is used as fuel of the boiling type hot air furnace, and the other part is disposed as waste material.

By using the integrated drying and dry separation apparatus for upgrading raw coal and the method thereof according to the present invention, the defects caused by respectively using the drying equipment or the dry separation equipment are overcome. Not only the dry separation method and the drying process are joined organically to exert their respective advantages, but also the application scope of the apparatus is extended, along with less investment and lower production cost, which facilitate the spread and application of the coal upgrading technique; in addition, the energy waste is greatly avoided.

BRIEF DESCRIPTION OF DRAWINGS

The technical solution of the present invention will be described hereinafter with reference to the attached FIG. 1 and FIG. 2. As for the following detailed embodiments, unless particularly specified, the components or methods used therein are conventional ones, and the connecting relations among various conventional components use the conventional ones.

DETAILED DESCRIPTION

In which,

| | | |
|---|---|---|
| 1: a hot air furnace | 2: a belt conveyor for raw coal | |
| 3: a settling chamber | 4: a first main fan | 5: a dryer |
| 6: a belt conveyor for dried products | 7: a dust remover | |
| 8: a draught fan | 9: an exhaust pipe | 10: a second main fan |
| 11: a cyclone dust remover | 12: a dry separator | |
| 13: a belt conveyor for fancy coal | 14: a belt conveyor for coal gangue | |
| 15: a belt conveyor for feeding coal | | |

Figure 1:
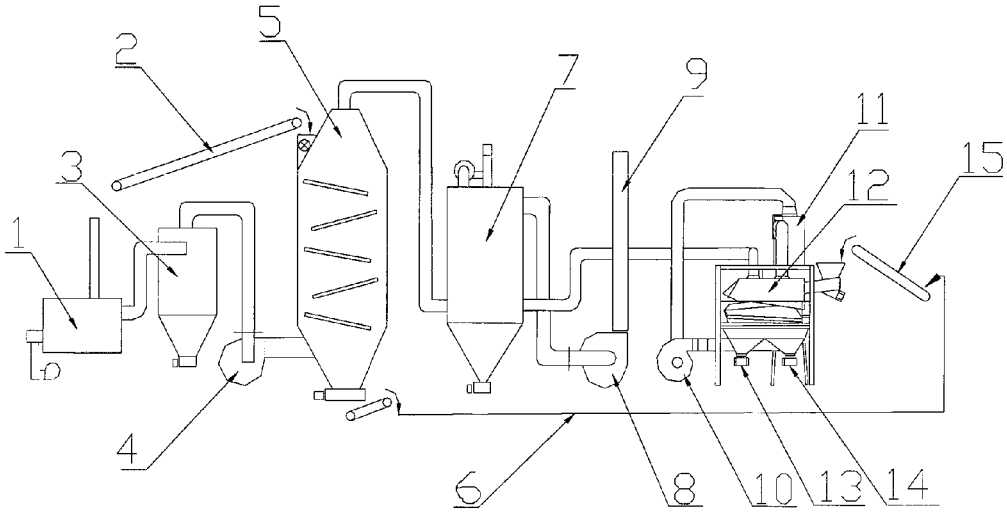
FIG. 1 is the structure diagram of the integrated drying and dry separation apparatus for upgrading raw coal according to the technical solution of the present invention.

As shown in FIG. 1, an integrated drying and dry separation apparatus for upgrading raw coal comprises a coal supply system, a hot air system, a drying system, a dedusting and exhausting system, and a dry separation system. The coal supply system can be divided into two portions, that is, a coal supply for dry raw coal and a coal supply for hot air furnace; the coal supply system respectively supplies the raw coal to the hot air system and the drying system by using a raw coal conveyor; the raw coal conveyor shown in FIG. 1 is a belt conveyor for raw coal 2, but a chain type conveyor or other conventional conveyors for material can also be used.

The hot air system is a heat source portion of the drying system, said hot air system comprises a hot air furnace 1, a settling chamber 3 and a first main fan 4, and it supplies hot air with certain temperature pressurized by the first main fan 4 to the drying system, wherein the hot air with certain temperature is formed by removing sparks from flue gas produced in the hot air furnace 1 when passing through the settling chamber 3 and then mixing the processed flue gas with cold air; an air outlet of the first main fan 4 is connected to the lower portion of a dryer 5 in the drying system. Wherein, the temperature of said hot air formed by removing sparks from flue gas produced in the hot air furnace 1 when passing through the settling chamber 3 and then mixing the processed flue gas with cold air is about 50° C.-280° C., which is, preferably about 250° C.; hot air with other suitable temperature may also be formed according to the demands of the actual production. The hot air furnace 1 is a chain type hot air furnace or a boiling type hot air furnace.

The drying system is used to dry and dehydrate the raw coal, and to reduce the water content of raw coal; the dried coal products are delivered to the dry separation system by a conveyor for dried products. The core equipment of the drying system is a mixed-flowing vibrating dryer. The conveyor for dried products as shown in FIG. 1 is a belt conveyor 6 for dried products.

The dedusting and exhausting system is used to recycle the fine particles of coal dust, it comprises a dust remover 7 and a exhaust blower; the dedusting and exhausting system is connected between the drying system and the dry separation system; said exhaust blower consists of a draught fan 8 and an exhaust pipe 9. The dust remover 7 as shown in FIG. 1 is a bag type dust remover.

The dry separation system comprises a dry separator 12, a circulating fan and a cyclone dust remover 11, and is used to separate the dried raw coal into fancy coal, middling coal and coal gangue. The dry separator 12 in the dry separation system is a composite dry separator.

Figure 2:
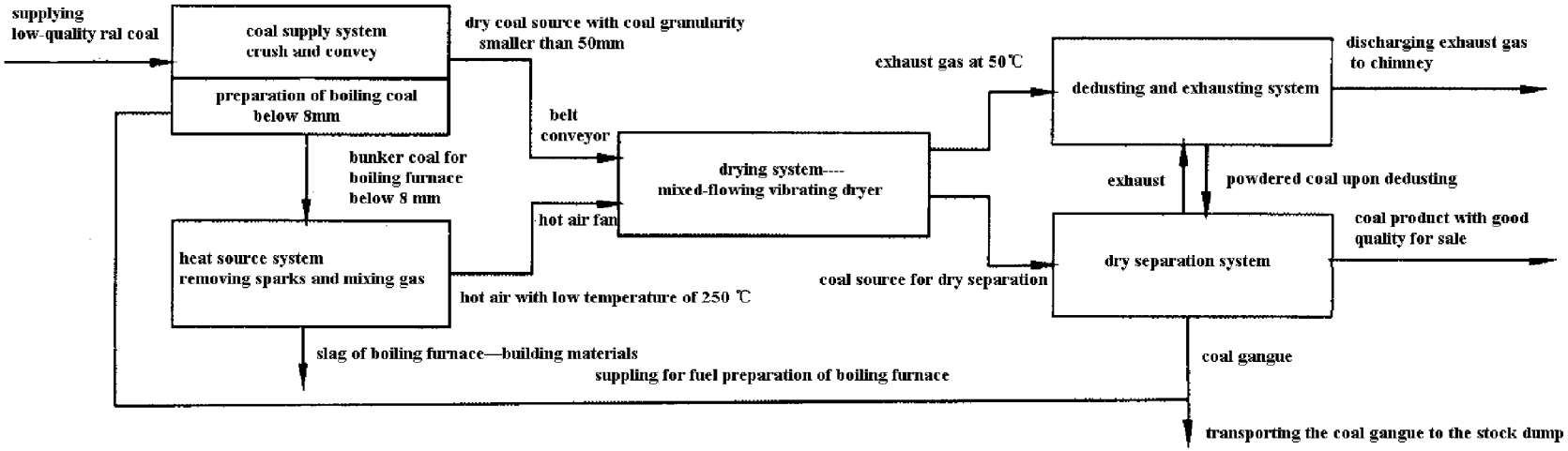
FIG. 2 is the modular flow chart of the integrated drying and dry separation method for upgrading raw coal according to the technical solution of the present invention.

Now the integrated drying and dry separation method for upgrading raw coal is described with reference to FIG. 1 and FIG. 2. FIG. 2 shows the modular flow chart of said method. The integrated drying and dry separation method for upgrading raw coal comprises the following steps:

1) supplying coal for drying and coal for a hot air furnace by using the coal supply system; low-quality raw coal is crushed and delivered by the coal supply system; dry coal source have been crushed with coal granularity bigger than 8 mm and smaller than 50 mm is delivered to the drying system via the belt conveyor for raw coal 2, and the coal powder have been crushed with coal granularity smaller than 8 mm is delivered to the hot air furnace 1. The hot air furnace 1 can be a chain type hot air furnace or a boiling type hot air furnace, the raw coal is directly used as fuel of the chain type hot air furnace when the lower heating value of the raw coal is bigger than 16000 KJ/kg, namely bigger than 3840 kilocalorie/kg; the boiling type hot air furnace is adopted as the hot air furnace 1 of the coal supply system when the lower heating value of the raw coal is smaller than 16000 KJ/kg;

2) supplying hot air with temperature between 150° C.-280° C. pressurized by the first main fan 4 to the lower portion of the dryer 5 in the drying system by using the hot air system, wherein the hot air is formed by removing sparks from the flue gas produced in the hot air furnace 1 and then mixing the processed flue gas with cold air; in FIG. 2, the hot air system is also referred to as the hot source system.

3) using the drying system to dry the raw coal: the drying system uses the mixed-flowing vibrating dryer, the coal flow passes through a multi-layered vibration bed from top to bottom and flows to a coal outlet, the hot air passes through the multi-layered vibration bed and is discharged via a top exhaust outlet, the macro-flow between the coal flow and the hot air is a counter flow, that is, both a vertical cross flow and a horizontal counter flow between the coal and the hot air are present within the dryer 5;

4) using the dedusting and exhausting system to remove the dust: the dedusting and exhausting system is composed of the dust remover 7 and the exhaust blower, the dust remover 7 separates coal powder from exhaust gas, and the separated coal powder is incorporated into coal product, the processed, cleaned exhaust gas is evacuated via the exhaust blower;

5) using the dry separation system to separate dried raw coal into fancy coal, middling coal and coal gangue, the fancy coal can be sold as coal product, the middling coal may be either incorporated into the fancy coal to be sold as coal product coal or returned to the coal inlet to be separated again, part of the coal gangue is used as fuel of the boiling type hot air furnace, and the other part is disposed as waste material.

More particularly, the technical advantages lie in that: sparks are removed from the hot flue gas produced in the hot air furnace 1 within the settling chamber 3, then the processed hot flue gas is fed into the lower portion of the dryer 5 by the first main fan 4, and the wet raw coal material is fed into the top portion of the dryer 5 by the belt conveyor for raw coal 2; after the wet raw coal material is dried uniformly, most of them are discharged from the lower portion of the dryer 5 by the belt conveyor 6 for dried product, while part of the fine material, following the hot air, flows into the bag type dust remover 7; the material separated by the bag type dust remover 7 is recycled as product, and the waste gas is discharged by the exhaust pipe 9 via the draught fan 8. The dried coal product is delivered into the dry separator 12 by the belt conveyor 15 for feeding coal to be separated, and the fancy coal and the coal gangue after separation are discharged respectively by the belt conveyor for fancy coal 13 and the belt conveyor for coal gangue 14. The second main fan 10 provides the wind with magnitude required for the dry separation of the dry separator 12, the cyclone dust remover 11 is connected in series with the second main fan 10 to remove the coarse particles of coal dust and to protect the impeller of the fan from wear; the bag type dust remover 7 is connected in parallel with the cyclone dust remover 11 to insure that the dust concentration contained in the gas discharged into the atmosphere is lower than the national standard, and inhale air directly from the surroundings of the dry separator 12 to form negative pressure operation, so as to improve the separation effect of the dry separator 12.

Furthermore, although the optimal design is given in the description mentioned above, conventional improvements on various components have been tested and carried out by the inventor, which can obtain good technical effect. For example, first drying and then dry-separating is not the only option for the joint operation flow, in case that the coal gangue content of the raw coal is relatively high while the surface water content (visible water content) is not high, where a dry separation operation can be used, the user should preferably select the solution of first dry-separating and then drying. Under the same investment condition, the solution of first dry-separating is removing the coal gangue and then drying. Compared with the solution of first drying, the production quantity of the upgraded coal in this solution can be improved by more than 20%-30%. Under the condition of the same production quantity of the upgraded coal, the investment in this solution can be reduced by about 30%. In case that the surface water content of the raw coal is too high or the coal gangue content is not high, where the dry separation operation could not proceed without a drying operation, first drying and then dry-separating is the only solution to be selected. For simplicity for discussing the present invention, other suitable materials, components or improvements on process are not described herein.

As mentioned above, the integrated drying and dry separation apparatus for upgrading raw coal and method thereof have been described clearly in details. Furthermore, a person skilled in the art would understand that various modifications in form or in details might be made without departing from the sprits and the scope of the present invention defined in the accompanying claims.

INDUSTRIAL UTILITY

The apparatus and method of the present invention not only organically join the dry separation method and the drying process to exert their respective advantages, but also extends the application scope of the apparatus. The present invention requires less investment and lower production cost, which facilitates the spread and application of the technique of coal upgrading.

The invention claimed is:

1. An integrated drying and dry separation apparatus for upgrading raw coal, comprising: a coal supply system, a hot air system, a drying system, a dedusting and exhausting system, and a drying separation system, the coal supply system is separable into two portions, a coal supply for dry raw coal and a coal supply for hot air furnace;

the coal supply system supplies raw coal to the hot air system and the drying system respectively by using a raw coal conveyor;

the hot air system is a heat source portion of the drying system comprises a hot air furnace, a settling chamber and a first main fan, the hot air system supplies hot air with certain temperature pressurized by the first main fan to the drying system, wherein the hot air with certain temperature is formed by removing sparks from flue gas produced in the hot air furnace when passing through the settling chamber and then mixing the processed flue gas with cold air, an air outlet of a first main fan is connected to a lower portion of a dryer in the drying system;

the drying system is configured for drying and dehydrating the raw coal, and for reducing the water content of the raw coal, wherein the dried coal products are conveyed to the dry separation system by a dried product conveyor;

the dedusting and exhausting system is configured for recycling fine particles of coal dust, comprising a dust remover and an exhaust blower, connected between the drying system and the dry separation system, the exhaust blower includes a draught fan and an exhaust pipe; and the dry separation system comprises a dry separator, a circulating fan and a cyclone dust remover, and is configured to separate the dried raw coal into fancy coal, middling coal and coal gangue.

2. The integrated drying and dry separation apparatus for upgrading raw coal according to claim 1, characterized in that, the temperature of said hot air formed by removing sparks from flue gas produced in the hot air furnace when passing through the settling chamber and then mixing the processed flue gas with cold air is about 50° C.-280° C.

3. The integrated drying and dry separation apparatus for upgrading raw coal according to claim 1, characterized in that, the temperature of said hot air formed by mixing with the cold air is about 250° C.

4. The integrated drying and dry separation apparatus for upgrading raw coal according to claim 1, characterized in that, said raw coal conveyor is a belt conveyor for raw coal, and said dried products conveyor is a belt conveyor for dried products.

5. The integrated drying and dry separation apparatus for upgrading raw coal according to claim 1, characterized in that, the core equipment of the drying system is a mixed-flowing vibrating dryer.

6. The integrated drying and dry separation apparatus for upgrading raw coal according to claim 1, characterized in that, said dry separator in the dry separation system is a composite dry separator.

7. The integrated drying and dry separation apparatus for upgrading raw coal according to claim 1, characterized in that, said hot air furnace is a chain type hot air furnace or a boiling type hot air furnace.

8. An integrated drying and dry separation process for upgrading raw coal by using the integrated drying and dry separation comprising a coal supply system, a hot air system, a drying system, a dedusting and exhausting system, and a drying separation system, wherein, the coal supply system can be divided into two portions, a coal supply for dry raw coal and a coal supply for a hot air furnace; the coal supply system supplies raw coal to the hot air system and the drying system respectively by using a raw coal conveyor;

the hot air system is a heat source portion of the drying system, it comprises a hot air furnace, a settling chamber and a first main fan; the hot air system supplies hot air with certain temperature pressurized by the first main fan to the drying system, wherein the hot air with certain temperature is formed by removing sparks from flue gas produced in the hot air furnace when passing through the settling chamber and then mixing the processed flue gas with cold air; an air outlet of the first main fan is connected to a lower portion of a dryer in the drying system;

the drying system is configured for drying and rehydrating the raw coal, and for reducing the water content of the raw coal, wherein the dried coal products are conveyed to the dry separation system by a dried product conveyor;

the dedusting and exhausting system is configured for recycling fine particles of coal dust, comprising a dust remover and a exhaust blower, connected between the drying system and the dry separation system; the exhaust blower consists of a draught fan and an exhaust pipe; and the dry separation system comprises a dry separator, a circulating fan and a cyclone dust remover, and is configured for separating the dried raw coal into fancy coal, middling coal and coal gangue;

wherein the process comprises the following steps:

1) supplying coal for drying and coal for the hot air furnace by using the coal supply system; the hot air furnace can be a chain type hot air furnace or a boiling type hot air furnace, the raw coal is directly used as fuel of the chain type hot air furnace when the lower heating value of the raw coal is larger than 16000 J/kg, namely larger than 3840 kilocalorie/kg; and the boiling type hot air furnace is adopted as the hot air furnace of the coal supply system when the lower heating value of the raw coal is less than 16000 KJ/kg;

2) supplying hot air with a temperature between 150° C.-280° C. pressurized by the first main fan to the lower portion of the dryer in the drying system by using the hot air system, wherein the hot air is formed by removing sparks from flue gas produced in the hot air furnace and then mixing the processed flue gas with cold air;

3) using the drying system to dry the raw coal: the drying system uses a mixed-flowing vibrating dryer, the coal flow passes through a multi-layered vibration bed from top to bottom and flows to a coal outlet, the hot air passes through the multi-layered vibration bed and is discharged via a top exhaust outlet, the macro-flow between the coal flow and the hot air is a counter flow, that is, both a vertical cross flow and a horizontal counter flow between the coal and the hot air are present within the dryer;

4) using the dedusting and exhausting system to remove the dust: the dedusting and exhausting system is composed of a dust remover and a exhaust blower, the dust remover separates coal powder from exhaust gas, and the separated coal powder is incorporated into coal product, the processed, cleaned exhaust gas is evacuated via the exhaust blower; and 5) using the dry separation system to separate the dried raw coal into fancy coal, middling coal and coal gangue, the fancy coal is sold as coal product, the middling coal may be either incorporated into the fancy coal to be sold as the coal product coal or returned to a coal inlet to be separated again, part of the coal gangue is used as fuel of the boiling type hot air furnace, and the other part is disposed as waste material.

* * * * *